US006347923B1

(12) United States Patent
Semmler et al.

(10) Patent No.: US 6,347,923 B1
(45) Date of Patent: Feb. 19, 2002

(54) COOLABLE BLADE FOR A GAS TURBINE

(75) Inventors: Klaus Semmler, Lauchringen; Bernhard Weigand, Filderstadt-Sielmingen, both of (DE)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/552,567

(22) Filed: Apr. 19, 2000

(30) Foreign Application Priority Data

May 10, 1999 (DE) ..... 199 21 644

(51) Int. Cl.[7] ..... F01D 5/08
(52) U.S. Cl. ..... 416/97 R
(58) Field of Search ..... 416/97, 96 R, 416/96 A, 95; 415/115, 116

(56) References Cited

U.S. PATENT DOCUMENTS

| | | | | |
|---|---|---|---|---|
| 4,474,532 A | * | 10/1984 | Pazder | 416/97 R |
| 4,775,296 A | * | 10/1988 | Schwarzmann et al. | 416/97 R |
| 4,992,026 A | * | 2/1991 | Ohtomo et al. | 416/97 R |
| 5,403,159 A | | 4/1995 | Green et al. | |
| 5,462,405 A | * | 10/1995 | Hoff et al. | 416/97 R |
| 5,498,126 A | * | 3/1996 | Pighetti et al. | 415/115 |
| 5,599,166 A | | 2/1997 | Deptowicz et al. | |
| 5,902,093 A | | 5/1999 | Liotta et al. | |
| 5,931,638 A | * | 8/1999 | Krause et al. | 416/97 R |
| 6,120,250 | * | 9/2000 | Durgin et al. | 416/97 R |
| 6,220,817 B1 | * | 4/2001 | Durgin et al. | 416/97 R |

FOREIGN PATENT DOCUMENTS

| | | |
|---|---|---|
| DE | 23 36 952 | 12/1982 |
| DE | 198 60 788 | 7/2000 |
| EP | 0 241 180 | 10/1987 |
| EP | 0 475 658 | 3/1992 |
| GB | 1188401 | 4/1970 |
| GB | 1 303 034 | 1/1973 |
| GB | 1 551 678 | 8/1979 |
| GB | 2 165 315 | 4/1986 |

OTHER PUBLICATIONS

United Kingdom Search Report dated Aug. 25, 2000.

* cited by examiner

*Primary Examiner*—Edward K. Look
*Assistant Examiner*—James M McAleenan
(74) *Attorney, Agent, or Firm*—Burns, Doane, Swecker & Mathis, L.L.P.

(57) ABSTRACT

A coolable blade for a gas turbine or the like, having a blade body and a blade root, in which case the blade body is composed of a suction-side wall and a pressure-side wall, which, while forming a cavity, are connected via a leading edge, at least partly via a trailing edge and via a blade tip, the cavity is subdivided by essentially radially running separating webs into passages which form a continuous, repeatedly deflected flow path for a cooling medium, at least one blow-out opening is provided for the cooling medium, and the separating web adjacent to the trailing edge has one or more through passages close to the blade tip.

9 Claims, 4 Drawing Sheets

COOLABLE BLADE FOR A GAS TURBINE

FIELD OF THE INVENTION

The invention relates to a coolable blade for a gas turbine, or the like, having a blade body and a blade root.

BACKGROUND OF THE INVENTION

Such a blade has been disclosed, for example, by German Patent Application 198 60 788.1, on which the invention is based. It essentially comprises a blade body and a blade root with an integrated cooling system. The blade body is composed of a suction-side wall and a pressure-side wall, which, while forming a cavity, are connected via a leading edge, a trailing edge and a blade tip. The walls define the profile shape and enclose the cavity within, which is utilized for cooling purposes. To this end, the cavity is subdivided into passages by essentially radially running separating webs. In the triple-pass cooling system described in this publication, a first separating web, starting from the blade root, runs radially outward right into the vicinity of the blade tip, and a second separating web, starting from the blade tip, runs right into the vicinity of the blade-root region. In this way, the cavity is subdivided into three radially running passages, which form a continuous flow path which is deflected twice and through which a cooling medium can flow. As a rule, the cooling medium is fed through the blade root, for example in a plane corresponding to the leading edge. When flow occurs through the passages, the cooling medium absorbs heat introduced from outside and leaves the blade in the region of the trailing edge. To this end, a row of blow-out openings, for example, are provided; there may also be a blow-out slot which is largely continuous in the radial direction.

Although such a cooling concept has proved successful in principle, problems have partly occurred, and these problems necessitate further improvements.

A first problem area lies in the fact that the cooling medium experiences a deflection of about 180° at the transition from one passage to the neighboring passage, as a result of which there is a risk of flow separation. Such a flow separation is undesirable, since there is an increased flow loss in the region concerned and the rate of flow of cooling medium is reduced. Furthermore, such flow-separation zones are extremely unstable, so that no constant throughput of cooling medium can be produced. As a result, local or even complete overheating of the blade may be observed, which in the most unfavorable case leads to total loss.

To avoid such flow-separation zones, baffle plates, for example, are in use; attempts are also made to deliberately influence the passage geometry by local contouring (thickening) of the separating webs. However, this leads to an increased cost in terms of design or production.

The region of the blade tip, in particular in the vicinity of the blade trailing edge, poses a further problem. This region corresponds with the rear passage (as viewed in the direction of flow), through which a cooling medium which is already greatly heated flows. The temperature gradient toward the wall and available for the heat transfer has greatly decreased relative to the inlet region. In addition, the quantity of cooling medium available for the heat dissipation is already greatly reduced as a result of the cooling air blown out via the trailing edge, so that sufficient cooling is exceptionally problematic overall, especially in the region of the blade tip at the trailing edge.

SUMMARY OF THE INVENTION

The object of the invention, in attempting to avoid the disadvantages described above, is to specify a coolable blade for a gas turbine, or the like, having a blade body and a blade root, in which, it is possible to increase the cooling effect in the region of the blade tip and/or the trailing edge and thereby prolong the service life thereof.

According to the invention, this is achieved in that, in a coolable blade having a blade body and a blade root, the separating web which is adjacent to the trailing edge is provided with at least one through passage close to the blade tip. The result of this is that some of the cooling medium, during the deflection, is branched off from the passage assigned to the leading edge into the center passage and is fed directly to the third passage assigned to the trailing edge. Thus, cooling medium, which has a comparatively low temperature, passes into the region which is especially at risk of overheating. Since a lower pressure prevails in the trailing-edge region—and thus in the rear passage—than in the center passage, the cooling medium is drawn off at high velocity through the through passage. This effect also helps considerably to improve the cooling effect.

In addition, the drawing-off of cooling medium through the through passage prevents a flow separation in this region as a result of the deflection during the transfer from the front passage to the center passage. The thickening of the separating web practiced hitherto in this region may be dispensed with.

Taking this basic concept as the starting point, specific adjustment of the bypass of the cooling-air transfer may be carried out by the variants described below in such a way that the requisite heat dissipation is exactly achieved.

To optimize the flow conditions in the region referred to, not only the number and arrangement of the through passages but also the cross-sectional profile of the through passages may be varied. To set a predetermined entry velocity of the cooling medium into the rear passage, the cross section may be designed to diverge or converge in the direction of flow.

For a number of applications, it has proved to be expedient to assign a guide web to the through passage or through passages, as a result of which an essentially axially running tip cooling passage is obtained. This configuration is of particular importance especially at particular high thermal loads in this region, as may be observed in the case of blades with a free end and blades with a crown. Depending on the requirement, the guide web may be arranged so as to be continuous between the separating web and the trailing edge, so that mixing of the drawn-off partial flow with the deflected main flow is completely prevented. Alternatively, the guide web may be provided with essentially radially running through-holes or else be composed of individual segments arranged at a distance from one another, so that partial mixing of both partial cooling flows is permitted.

Furthermore, the guide web may have a curved contour section, so that a flow separation of the cooling medium after entry into the rear passage is avoided. The guide web thus has the function of a baffle plate or a deflecting rib. Furthermore, discharge passages may be arranged in the region of the blade tip in order to specifically assist locally the cooling of the blade.

Finally, in the rear passage and/or in the tip passage in the region of the blade tip and/or the trailing edge, additional cooling elements may be provided on the inside of the wall or so as to be continuous between the suction-side wall and the pressure-side wall. Such cooling elements are built-in components which enlarge the surface required for the heat transfer and intensify the heat transfer. Especially effective are cooling elements in the form of semi-cylinders, spherical sections, ribs or cylinders.

BRIEF DESCRIPTION OF THE DRAWINGS

Four exemplary embodiments of the invention are shown in the drawing, in which.

DETAILED DESCRIPTION OF THE INVENTION

Figure 1:
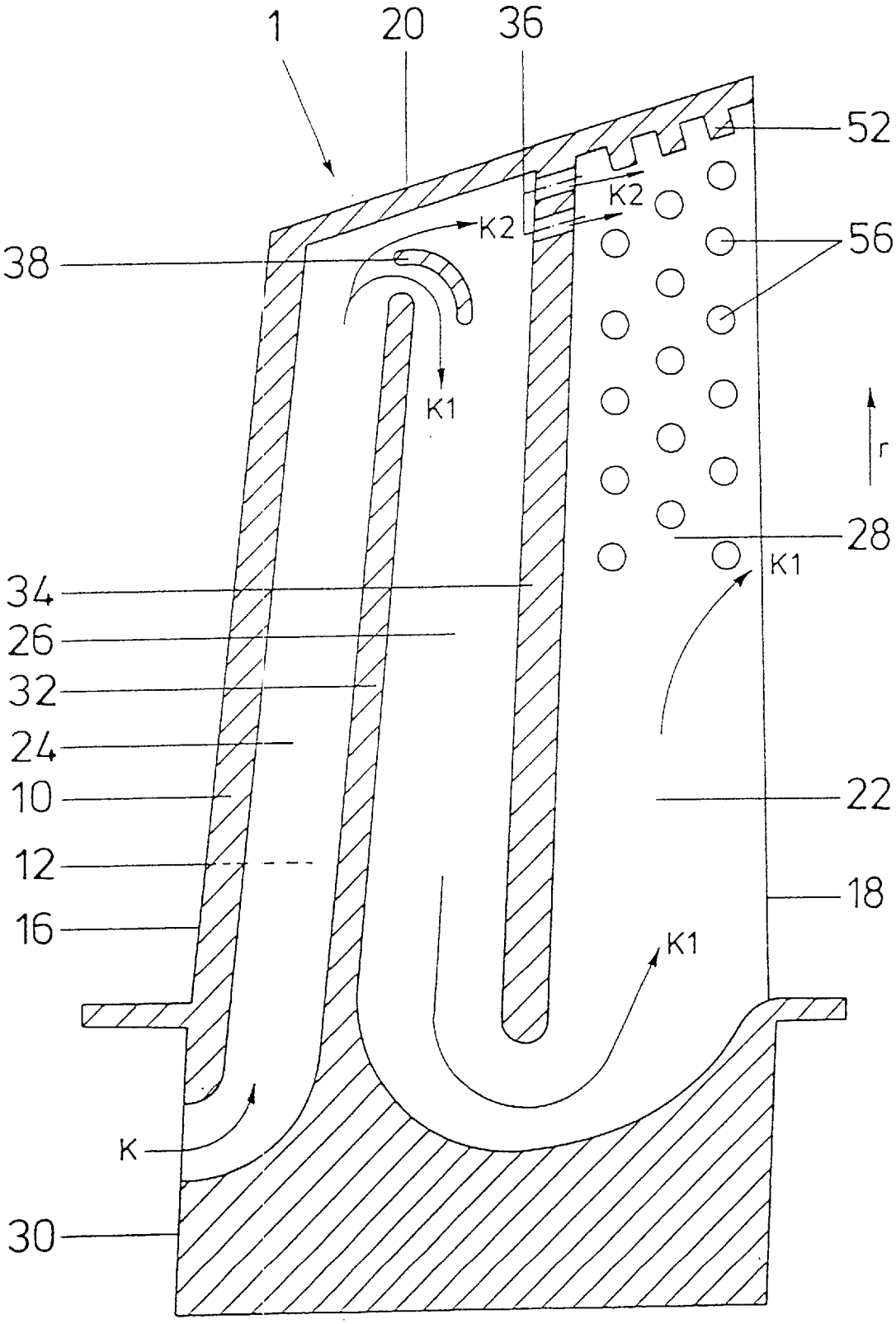
FIG. 1 shows a blade in sectional representation, basic concept.

Only the elements essential for the understanding of the invention are shown. Corresponding components are provided with the same reference numerals.

The basic concept underlying the invention is shown by FIGS. 1 to 4.

A coolable blade 1 comprises two main components: a blade body 10 and a blade root 30. The blade body 10 is composed of a suction-side wall 12 and a pressure-side wall 14 (not shown on account of the sectioning), which in each case are opposite one another and are connected to one another via a leading edge 16 and a trailing edge 18. There is a blade tip 20 at the top as a closure, which results in a cavity 22 which, starting from the blade root 30 in the radial direction r, extends essentially continuously up to the blade tip 20. In the region of the trailing edge 18, there is a connection between the suction-side wall 12 and the pressure-side wall 14 (not shown) merely in the region of the blade tip 20 and at the transition to the blade root 30, so that an otherwise radially continuous slot is produced.

There is a first separating web 32 in the cavity 22, and this separating web 32, starting from a region of the blade root 30, runs radially outward and is brought up close to the blade tip without touching the latter. Running in the opposite direction, there is a second separating web 34, which, starting from the region of the blade tip 20, is directed radially inward right into the region of the blade root 30 without touching the latter. In this way, the cavity 22 is subdivided into three essentially radially running passages 24, 26, 28, a continuous, twice deflected flow path being obtained for a cooling medium K.

The cooling medium K is fed in the region of the blade root 30 to the passage 24 assigned to the leading edge 16 and first of all flows upward in the radial direction to the blade tip 20. It is deflected there, in the course of which a first partial flow K1 is forced radially inward by a baffle plate 38 into the center passage 26 and, after being deflected again in the region of the blade root 30, enters the passage 28 assigned to the trailing edge 18 and from there discharges from the blade. In its top half assigned to the blade tip 20, the passage 28 has cooling elements in the form of pins 56, which serve to enlarge the surface. This takes into account the fact that the cooling medium K has assumed a comparatively high temperature due to constant absorption of heat and its velocity has been reduced as a result of the blowout along the trailing edge which can occur through a row of blow-out openings, or a blow-out slot which is largely continuous in the radial direction, as discussed above, with regard to German Patent Application No. 198 60 788.1. In order to ensure sufficient cooling of the region referred to, the surface available for the heat transfer therefore has to be enlarged or the heat transfer must be greatly intensified.

The special feature of the concept according to the invention, then, consists in the fact that the separating web 34 in the region of the blade tip 20 has through passages 36. As a result of the pressure difference between the passage 28 and the passage 26, a partial flow K2 is drawn off from the transition region between the passage 24 and the passage 26 between the baffle plate 38 and the blade tip 20 and enters the passage 28 at a high velocity. The partial flow K2 is directed via the through passages specifically into a zone of low flow velocities and low heat transfer. The temperature of the partial flow K2 is considerably lower than that of the partial flow K1 in the top region of the passage 28, so that especially effective cooling is made possible in this region. Additional ribs 52 on the inside of the blade tip 20, just like the pins 56 described above, serve to specifically increase the heat transfer.

In this specific case, two through passages 36 which have a constant cross section are provided. They can therefore be made in the separating web 34 in a simple and cost-effective manner. of the two through passages 36, the top one runs close to the inside of the blade tip 20, so that no wake zone or no flow separation can occur at the transition from the inside of the blade tip 20 to the separating web 34.

It goes without saying that the partial flow K2 may be varied within wide limits by a suitable selection of the number, arrangement and geometrical configuration of the through passages 36, as a result of which optimum matching to the heat quantity to be dissipated is made possible.

Figure 2:
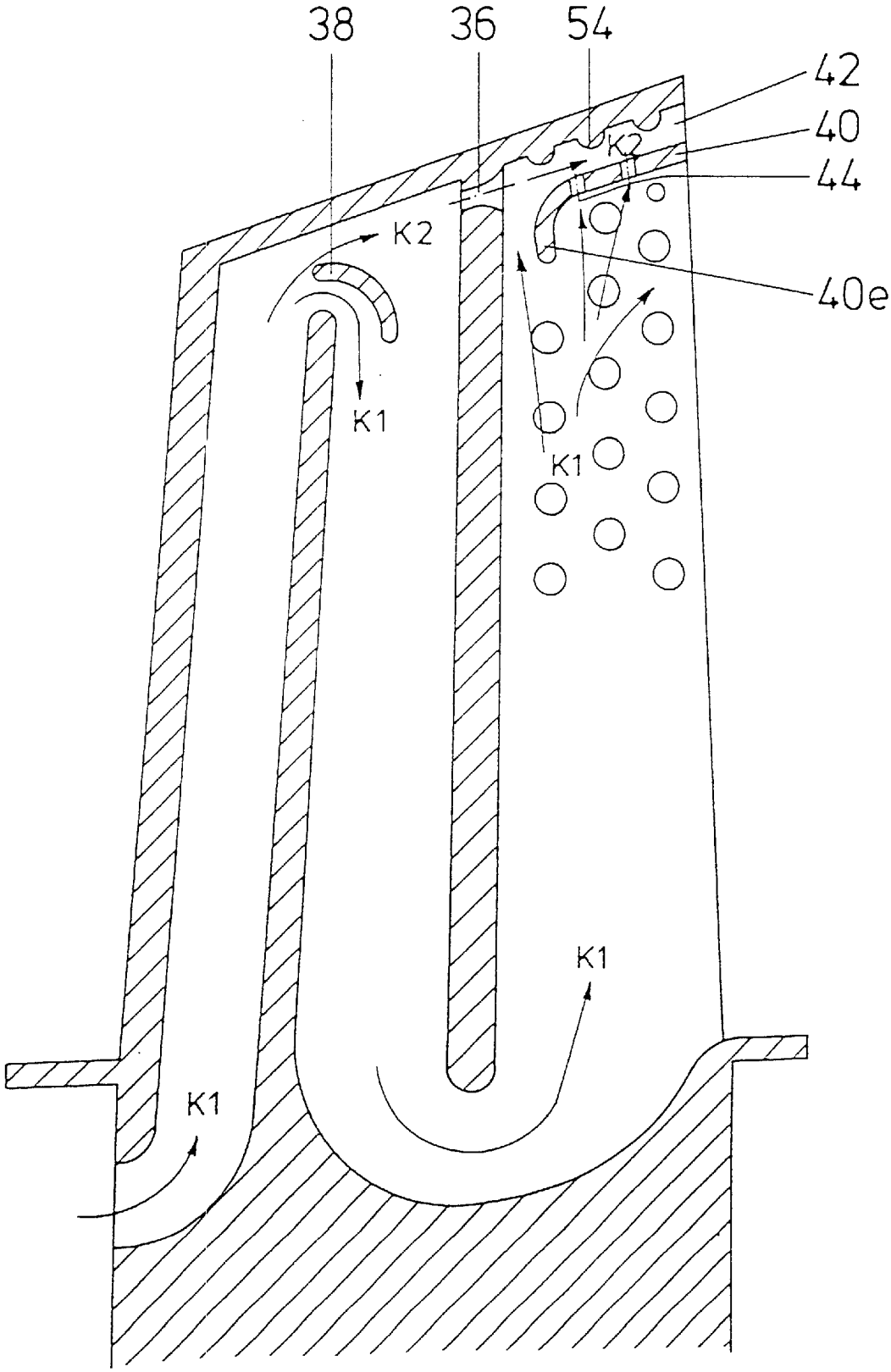
FIG. 2 shows a blade according to FIG. 1 with deflecting rib.

The blade 1 shown in FIG. 2 differs from the blade described above mainly due to the attachment of a guide web 40 in the passage 28. The guide web 40 has a curved contour section 40*e*, so that a type of deflecting rib is formed. The guide web 40 is assigned to the through passage 36 in such a way that the partial flow K2 entering the passage 28 is directly passed into a tip cooling passage 42, which is formed between the blade tip 20 and the guide web 40. An intermediate space is produced between the contour section 40*e* and the separating web 34, and some of the partial flow K1 passes through this intermediate space and thus prevents a flow separation of the partial flow K2 discharging from the through passage 36.

The guide web 40 has two essentially radially running through-holes 44, through which further portions of the partial flow K1 pass and deflect the partial flow K2 slightly in the direction of cooling elements in the form of semi-cylinders 54.

Figure 3:
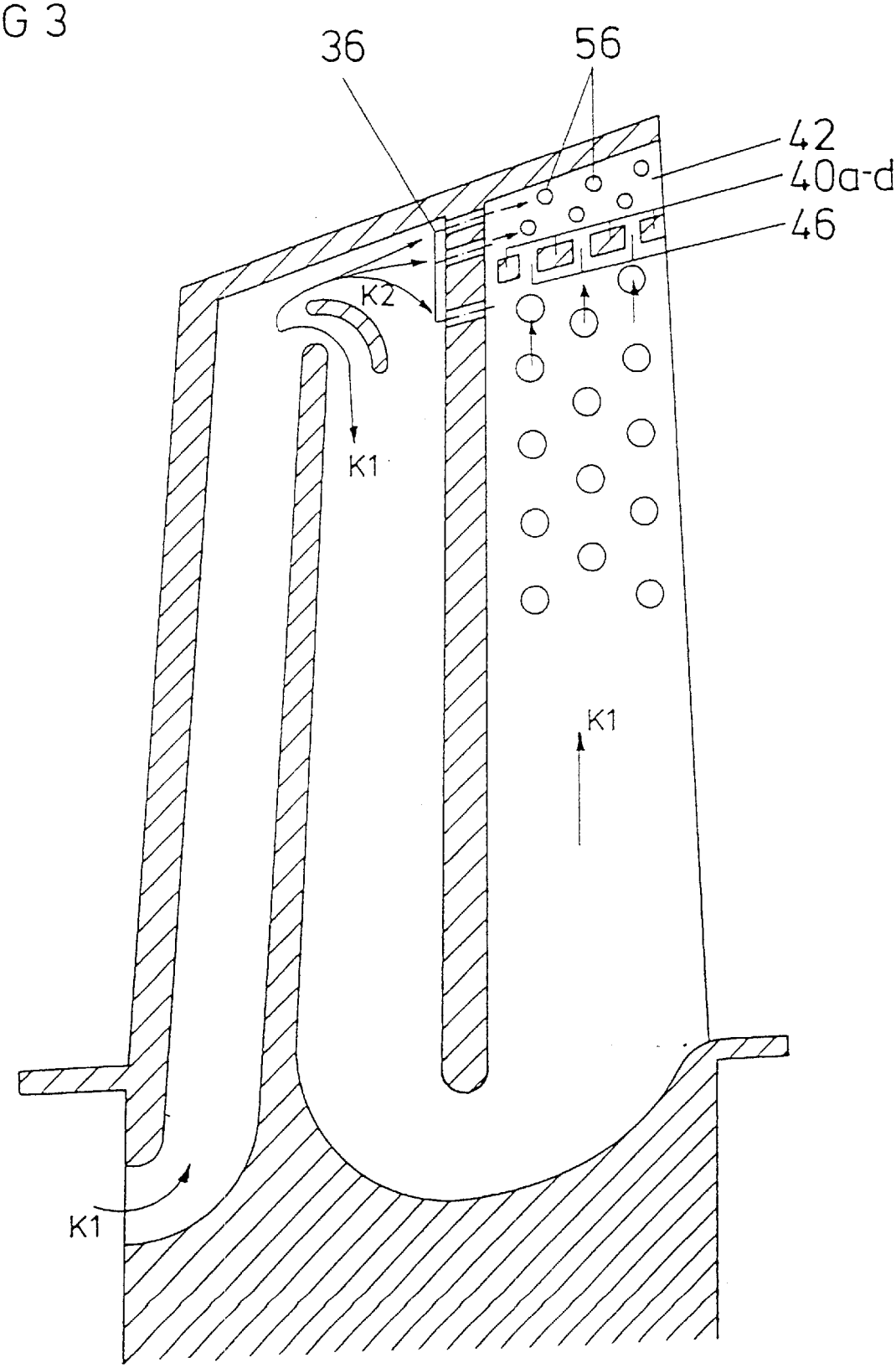
FIG. 3 shows a blade according to FIG. 1 with segmental guide web.

FIG. 3 shows a variant in which the guide web is composed of segments 40*a*, 40*b*, 40*c*, 40*d*, which are arranged at a distance from one another while apertures 46 are formed. A tip cooling passage 42 is again obtained between the guide web 40 and the blade tip 20, in which case pins 56 cool in particular the suction-side wall 12 and the pressure-side wall 14 in a locally intensified manner.

A total of three through passages 36 are provided, of which two are assigned to the tip cooling passage 40 and the third is assigned to the passage 28.

Figure 4:
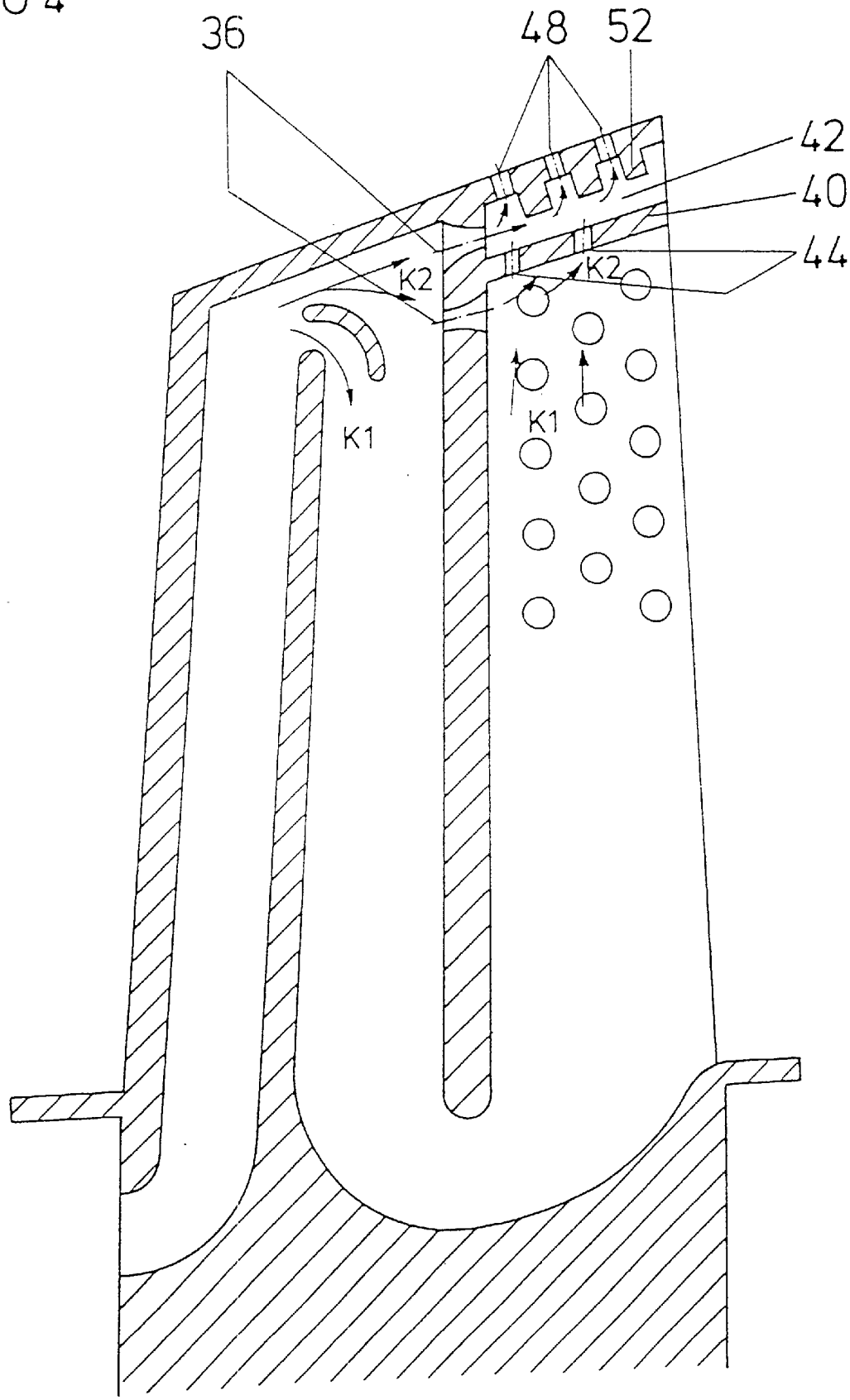
FIG. 4 shows a blade according to FIG. 1 with a continuous guide web.

In the variant according to FIG. 4, the guide web 40 is arranged so as to be continuous between the separating web 34 and the trailing edge 18. A tip cooling passage 42 which is essentially closed off from the passage 28 and into which one of two through passages 36 opens is thus obtained. The second through passage 36 opens directly adjacent to the guide web 40 into the passage 28. Radially running through-holes 44 in the guide web 40 ensure that the partial flow K2 entering the tip passage 42 is partly deflected in the direction of the blade tip 20 and leaves the blade 1 there in the region of the blade tip 20 through discharge passages 48. Direct, additional cooling therefore takes place there.

The cooling concept described above may be adapted to the actual requirements in a simple manner and is equally suitable for guide and moving blades.

What is claimed is:

1. A coolable blade for a gas turbine, comprising:

a blade body and a blade root, wherein the blade body has a cavity formed between a suction-side wall and a pressure-side wall which are connected along a leading edge, and are connected at least partly along a trailing edge and along a blade tip, the cavity being subdivided by a substantially radially extending separating web to form a continuous, repeatedly deflected flow path for a cooling medium, and at least one blow-out opening is provided for the cooling medium, wherein the separating web is adjacent to the trailing edge and has one or more through passages close to the blade tip, the passages having a cross-sectional profile varying in the direction of flow of the cooling medium.

2. A coolable blade for a gas turbine, comprising:

a blade body and a blade root, wherein the blade body has a cavity formed between a suction-side wall and a pressure-side wall which are connected along a leading edge, and are connected at least partly along a trailing edge and along a blade tip, the cavity being subdivided by a substantially radially extending separating web to form a continuous, repeatedly deflected flow path for a cooling medium, at least one blow-out opening is provided for the cooling medium, wherein the separating web is adjacent to the trailing edge and has one or more through passages close to the blade tip, and a guide web adjacent to the through passages and arrranged for forming a tip cooling passage, the guide web being continuous between the separating web and the trailing edge and having substantially radially extending through-holes or being composed of segments arranged at a distance from one another.

3. The blade as claimed in claim 2, wherein the guide web has a curved contour section.

4. The blade as claimed in claim 1, including discharge passages opening substantially radially in the region of the blade tip.

5. The blade as claimed in claim 1, including cooling elements integrated in a passage of the cavity.

6. The blade as claimed in claim 5, wherein the cooling elements are in the form of semi-cylinders, spherical sections, ribs or pins.

7. The blade as claimed in claim 1, including cooling elements integrated in a tip passage of the cavity.

8. The blade as claimed in claim 1, including cooling elements integrated in a passage and a tip passage of the cavity.

9. The blade as claimed in claim 2, wherein at least one of the through passages in the separating web is on a side of the guide web toward the blade tip, and at least one of the through passages in the separating web is on the opposite side of the guide web away from the blade tip.

* * * * *